US005453920A

United States Patent [19]

Eubanks

[11] Patent Number: 5,453,920

[45] Date of Patent: Sep. 26, 1995

[54] TROUBLE LIGHT HAVING A SHROUD WITH SEE-THROUGH OPENING

[76] Inventor: William W. Eubanks, 11630 Wilmot Rd., Kenosha, Wis. 53142

[21] Appl. No.: 207,208

[22] Filed: Mar. 8, 1994

[51] Int. Cl.[6] ..... F21V 15/00; F21L 15/12

[52] U.S. Cl. ..... 362/376; 362/186; 362/268; 362/280; 362/344

[58] Field of Search ..... 362/186, 268, 362/280, 319, 321, 344, 376, 368, 307, 399, 328, 335, 455, 109

[56] References Cited

U.S. PATENT DOCUMENTS

| | | | |
|---|---|---|---|
| 728,357 | 5/1903 | Bernegau . | |
| 1,329,187 | 1/1920 | Kline | 362/328 |
| 1,587,151 | 6/1926 | Zeng | 362/328 |
| 1,717,754 | 6/1929 | Brady . | |
| 1,814,540 | 7/1931 | Bander . | |
| 2,371,775 | 3/1945 | Pope | 362/186 |
| 2,394,231 | 2/1946 | Burski | 362/328 |
| 2,544,859 | 3/1951 | Quam | 362/335 |
| 2,785,293 | 3/1957 | Smith et al. | 362/319 |
| 4,141,062 | 2/1979 | Trueblood | 362/400 |

*Primary Examiner*—Ira S. Lazarus
*Assistant Examiner*—Y. Quach
*Attorney, Agent, or Firm*—Arthur J. Hansmann

[57] ABSTRACT

An electric trouble light assembly including a shroud and a guard and with an opening in the shroud at a location out of line of vision from the bulb included in the assembly so that the user can look through the opening and view the work station. Magnifying lenses can be placed in the shroud opening, and there can also be a viewing opening in a guard on the front face of the assembly, and a magnifying lens can be supported on the guard. Finally, a cover is movably mounted on the shroud for movement into and out of a position of closing the shroud viewing opening.

20 Claims, 3 Drawing Sheets

TROUBLE LIGHT HAVING A SHROUD WITH SEE-THROUGH OPENING

This invention relates to a trouble light which has an arrangement for viewing through the light shroud and past the light without interference from the brilliance of the light.

BACKGROUND OF THE INVENTION

Trouble lights with shrouds are well-known and are utilized for various types of service work. These lights commonly have a shroud for shade to one side of the lamp itself and thereby shield against having the lamp shine directly into the eyes of the user. However, in order to look directly at the workpiece, the user must move the trouble lamp to one side so that the line of sight is direct between the eye and the workpiece. This of course results in offsetting the light to where it is less effective in illuminating the workpiece.

The present invention improves upon trouble lights as known in the prior in that the present invention provides for a shroud or shade which has a see-through opening therein and which therefore permits the user to place the trouble light and his line of vision on the one direct line between his eye and the workpiece. In that arrangement, the user can clearly see the workpiece and do detailed or delicate work on the workpiece because the user's view of the workpiece is improved by virtue of having the trouble light in line with the line of vision, rather than being positioned to one side in order to permit a view of the workpiece.

In accomplishing this objective, the present invention provides for an opening in the shroud or shade of the trouble light and with the opening being positioned so that the lamp included in the trouble light does not directly shine into the user's eyes and thereby impede clear vision. That is, the opening in the shroud is offset relative to the lamp in the trouble light so that the lamp cannot shine through the opening into the user's eyes when the user has positioned the trouble light directly along the line of sight from the user's eyes and to the workpiece.

Additionally, the trouble light of this invention provides for the inclusion of a magnifying lens which enhances the user's vision, and the lens is removably positioned in the opening on the shroud of this trouble light. Still further, there can be a lens, and it can be in addition to the first-mentioned lens, positioned in the mesh-type guard at the front of the trouble light and of course with that lens being in the line of sight with the first-mentioned lens, all to further enhance the user's vision of the workpiece.

Still further, the present invention provides for the ready and easy displacement of the lens on the shroud, simply by sliding the lens to an out-of-the way location on the shroud, and the user can then simply look through the opening which is free of the lens. Additionally, the present invention has a cover or closure which is movably mounted on the shroud and can be positioned over the opening when it is desired to preclude viewing through the opening, and the cover can be readily and easily moved away from the opening so that viewing through the opening, with or without the lens, can be accomplished. U.S. prior art patents U.S. Pat. Nos. 728,357 and 1,717,754 and 1,814,540 all show lights having an attachment of a lens on the light housing or the like, for enhancing vision of the workpiece when it is viewed through the lens. However, these prior art disclosures do not relate to an arrangement of a trouble light with a shroud having an opening offset from the location of the lamp so that the user can look through the opening without looking directly at the lamp, and the arrangement can be such that the opening does not have a lens therein, at the option of the user's arrangement thereof. Those patent disclosures do not reveal a trouble light where the lens can be moved into and out of the opening in the light shroud and with the lens being stored on the shroud in the inoperative position. Also, the lens mounting in those patents is not incorporated in the shroud itself, as it is in the present invention.

Another prior art disclosure is U.S. Pat. No. 4,141,062, but that patent does not disclose the see-through opening in the shroud and in a line offset from the lamp itself. All of the aforementioned patents are U.S. patents and they do not disclose the trouble light with a hemispherically-shaped shroud to one side of the lamp and with the end portion of the shroud having a see-through opening and with a lens which can be positioned into the opening or moved on the shroud to an inoperative position away from the opening and also the present invention has a provision for a cover which can be positioned over the opening and thereby have the shroud serve as the conventional and solid shade or shroud to preclude all light passage through the shroud.

DETAILED DESCRIPTION OF THE PREFERRED EMBODIMENT

Figure 1:
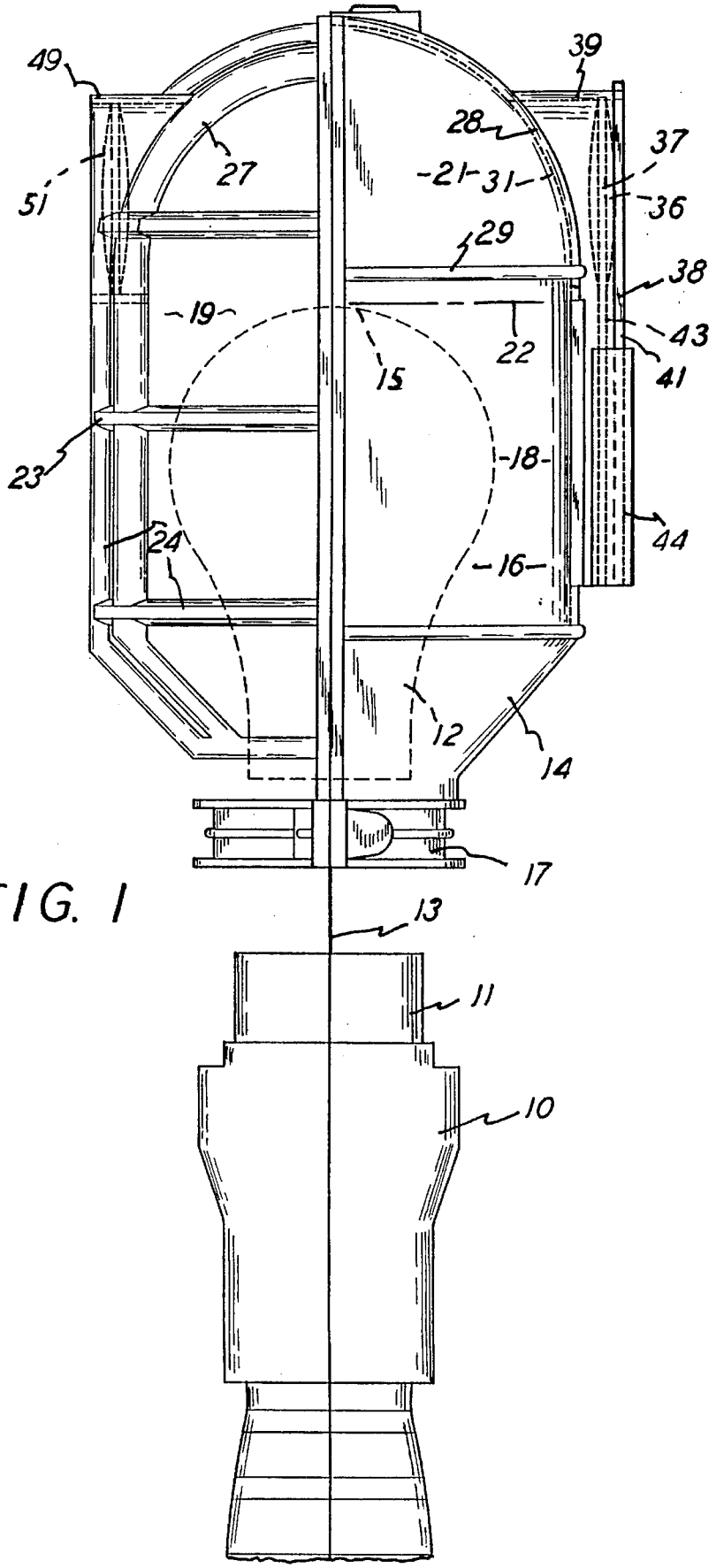
FIG. 1 is a side elevational view, in exploded format, showing a preferred embodiment of this invention.

The invention is of a trouble or service or work light assembly which is an electric system including a conventional assembly base 10 which serves as a handle for gripping by the user and which receives the electric wires which are not shown but which would be conventional. That is, the assembly of this invention is generally the same as that shown in U.S. Pat. No. 4,141,062, except for the portion which is claimed herein and which will be hereinafter described as novel subject matter. Base 10 would include a conventional lamp socket portion 11 into which an electric bulb 12 would be deposited in a threaded relationship to extend upwardly therefrom along the center line designated 13. Thus, the very top bulb circumference 15 extends a distance along the center line 13 from the base 11 when the entire assembly is made, and that of course is when the bulb 12 is inserted into the base socket 11 in the conventional manner mentioned and as will be understood by anyone skilled in the art.

The novelty of this invention resides in the shroud 14 which blocks or at least shades the light rays from the bulb 12 and to the right, as viewed in FIG. 1, in that the shroud 14 has a generally hemispherical solid wall 16 extending to one side of the bulb 12 and in essence nesting with the bulb 12 to have a center of curvature approximately the same as the center line 13. The shroud 14 is elongated along the center line 13 and, is semi-circular in the intermediate section designated 18, and that is the section which is mainly blocking the emission of light rays to the right, as viewed in FIG. 1, and thus serving the purpose of precluding the shining of light into the eyes of the user, but permitting the light to shine to the left of the center line, such as into the area labeled 19, and thereby illuminate the workpiece which is disposed leftward, as viewed in FIG. 1.

Shroud 14 has an upper portion designated 21 which is shown to be in a configuration of a one-quarter sphere, and the portion 21 is completely disposed above a line designated 22 which is tangential to the bulb upper spherical surface 15. Thus, the entire shroud 14 nests relative to the bulb 12 and thereby has the curvature configuration similar to that of the bulb 12 to completely surround at least the right half of the bulb 12, as viewed in FIG. 1.

Figure 4:
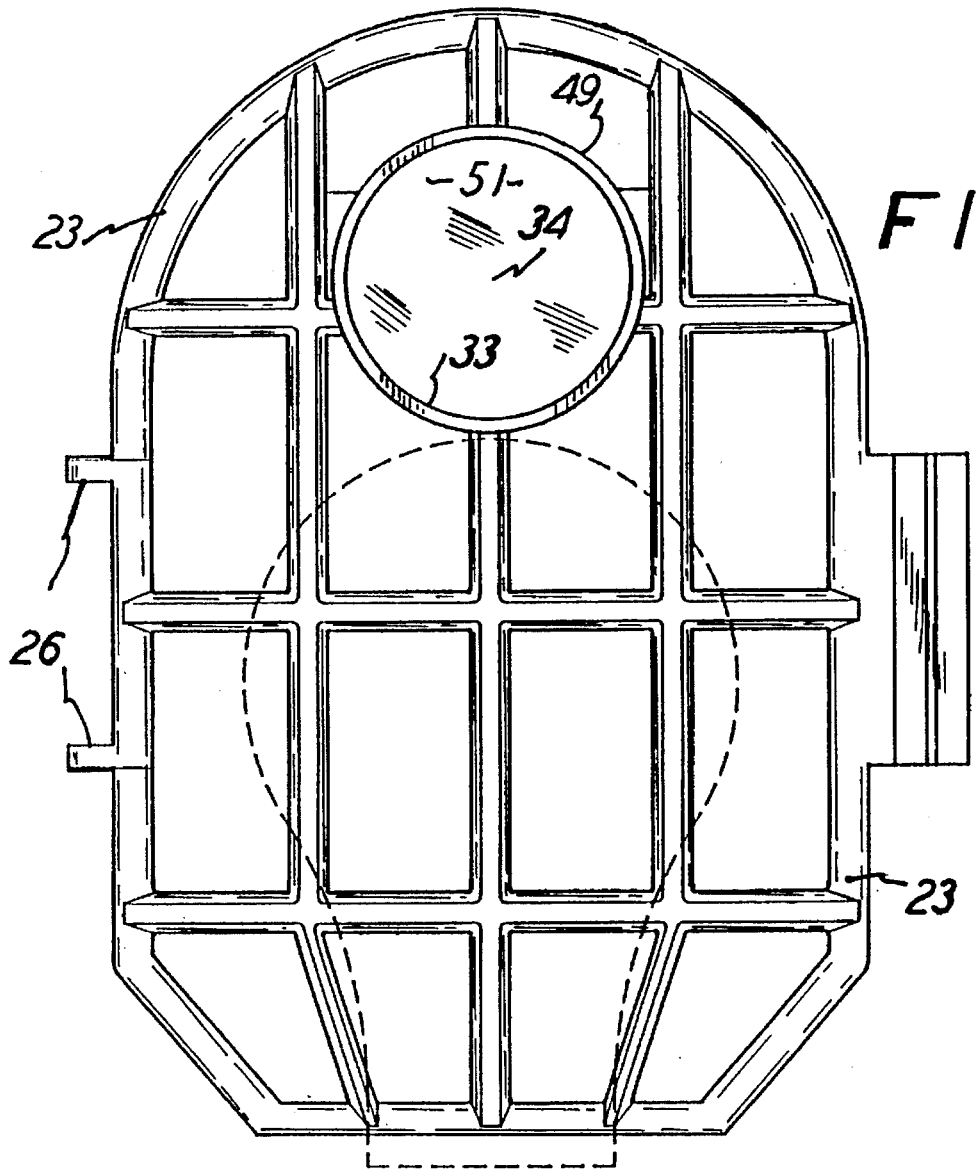
FIG. 4 is front elevational view of a portion of the trouble light shown in FIG. 1.

The assembly also has a mesh-type guard 23 conventionally and suitably attached to the shroud 14 and having the mirror image hemispherical or curvature configuration of the shroud 14. The guard 23 has the usual wire or like strands 24 extending therethrough for forming the mesh-type guard and thereby presenting a protector for the left half of the assembly, as viewed in FIG. 1. Of course the guard 23 can be suitably swung between its closed or assembled position with the shroud 14 and also it can be swung to an open position free from the shroud 14 except for perhaps a hinge to connect therewith, such as with a conventional hinge mounting at 26, as seen in FIG. 4. Therefore, the guard 23 also has a quarter sphere configuration at 27 to be the mirror image, in general, of the shroud quarter sphere portion 21.

The foregoing describes a basically conventional type of trouble light assembly, such as that in U.S. Pat. No. 4,141,062, and the basic assembly thus described will be understood by anyone familiar with this art.

Figure 2:
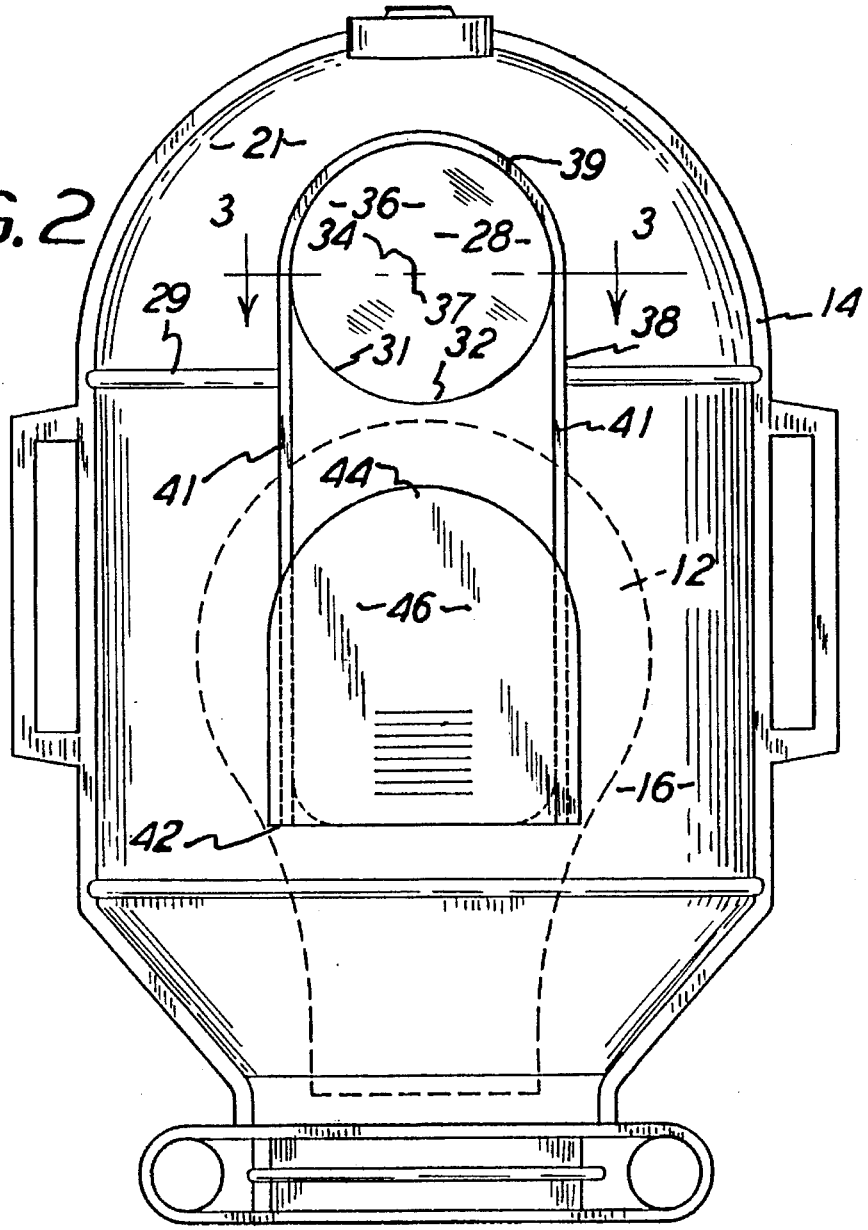
FIG. 2 is a right side elevational view of FIG. 1.

FIGS. 1 and 2 show that the shroud quarter-spherical extended portion 21 has a circular opening 28 extending therethrough and being central on the quarter spherical shroud portion 21, as best seen in FIG. 2. A shroud reinforcing portion 29 extends between the shroud portion 18 and the quarter-sphere shroud portion 21, again, as seen in FIGS. 1 and 2. The opening 28 permits light to pass therethrough, including the light available for viewing by the user who of course is viewing from the right side of the shroud 14, as viewed in FIG. 1, or from the near side, as viewed in FIG. 2. That is, the shroud 14 blocks all of the light from the lamp or bulb 12 except the light which the viewer can observe through the opening 28, and thus the viewer has a line of sight which can be anywhere within the circumference 31 of the opening 28, and that line of sight can of course be perpendicular with respect to the center line 13 of the entire assembly. However, it will of course be seen and understood that the lower edge 32 of the opening's circumference 31 is above the bulb's upper surface 15, that is, above the tangent line 22, and thus there is no direct viewing of the bulb 12 to impair visibility when the user is looking through the opening 28. With that arrangement, the user can illuminate the workpiece which is to the left, as viewed in FIG. 1, and he can also look through the opening 28 without being blinded by the light rays from the lamp or bulb 12. The drawings also show that the overall size of the opening 28 is less than half the overall size of the portion 21. In that manner, the workpiece is illuminated and the possibility of greater visibility and detail work is achieved as the user views the workpiece through the opening 28.

Similarily, FIG. 4 shows that the guard 23 has an opening 33, that is, it has a space where there is none of the mesh 24 of the guard 23, and thus the line of vision through the opening 28 can continue on through the opening 33 and onto the workpiece which can be in line with the central common axis for the openings 28 and 33 as represented by the designation 34.

To even further enhance the visibility of the illuminated workpiece, the shroud 14 supports a magnifying lens 36 which has its central axis 37 coincident with the axis 34 of the opening 28, but of course the lens 36 is disposed parallel to the center line 13 so that the optimum magnification is achieved when the viewer looks through the lens 36 and through the opening 28 and at the workpiece.

The lens 36 can be movably and removably supported on the shroud 14 by means of a track or support 38 which is suitably affixed with the shroud 14 and is extending in the direction parallel to the center line 13. The track 38 terminates in a semi-circular upper portion 39 which serves to enclose and secure the lens 36 in the position shown in FIG. 1. Of course the lens 36 is of a size coincident with the size of the opening 28, as indicated. The track 38 also extends in two parallel legs 41 which extend substantially throughout the solid wall 16 to the lower end 42 of the track 38. The track 38 has a groove 43 in the two legs 41 and in the upper curvature portion 39, and the circumferential edge of the lens 36 is nested in the grooves 43 such that the lens 36 can slide along the track 38 and thus either be positioned in the upper operative position shown in FIG. 1, or it can be slid downwardly to a position out of the opening 28 and toward the lower ends 42 of the track legs 41. That is, the shroud 14 is arranged to movably support the lens 36 which can be positioned in either the operative or inoperative position, and the lens 36 can in fact be completely slid out of the track 41 at the lower end 42, if desired.

Figure 3:
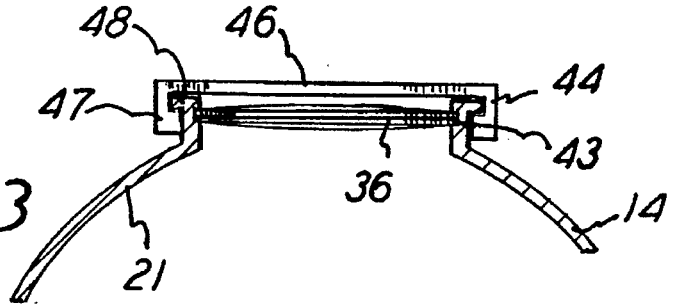
FIG. 3 is a sectional view taken along the line 3—3 of FIG. 2.

FIGS. 1, 2 and 3 further show that the track 38 slidably supports a cover 44 which spans the track between the legs 41, as seen in FIGS. 2 and 3, and the cover 44 is slidable to an upper position in line with the opening 28 to thus close the opening 28 and it is slidable down to the lowered and inoperative position shown in FIG. 2. Therefore, the cover 44 can be utilized to completely protect the lens 36 or to cover the opening 28 and thus preclude any light rays passing through the opening 28. Of course the cover 44 has an intermediate and planar portion 46 and it has flanged opposite sides 47 which nest with T-shaped track portions 48 on legs 41, for both the support and the sliding movement of the cover 44 on the track T-shaped portions 48, as particularly viewed in FIG. 3.

The opening 33 in the guard 23 is shown to have a tubular piece 49 coincident with the opening 33 and of course connected with the guard 23 to extend therefrom, as seen in FIGS. 1 and 4. Further, a lens 51 can be uprightly disposed in the opening 33 in the piece 49 to be parallel to the center line 13, as shown in FIG. 4. FIG. 1 shows the inner diameter of opening 33 in the piece 49 is uniform and the same as the overall diameter of the lens 51 and therefore the lens 51 is adequately supported in the tubular piece 49 to be slidably removable, to be removed, as mentioned later. The lens 51 can be a magnifying lens which is removable from the tubular or support member 49, but of course the vision axis of the lens 51 is coincident with that of the lens 36 so that the viewer has optimum image with regard to the work station or workpiece under consideration. With this arrangement, the assembly can be placed in any combination of arrangements, such as with no lenses 36 or 51, or with only one of the two lenses, or with both lenses or with the cover 44 in either the operative position over the opening 28 or in the inoperative position as shown in FIGS. 1 and 2 and with or without the lenses utilized at that time.

The lens 36 and cover 44 are both slidably frictionally held to the track 38, and both can be readily slid off the track 38 at the bottom ends 42.

What is claimed is:

1. An electric trouble light assembly comprising a lamp base having a lamp socket, an electric bulb disposed in said socket and extending therefrom along a center line of said light assembly to a distant location at a farthest extremity of said bulb, a lamp shroud attached to said base and extending therefrom in a generally hemi-spherical configuration and being spaced from said bulb at a location adjacent to only one side of said bulb and extending in a quarter sphere shaped end portion disposed beyond said distant location, said end portion being integral with and a continuation of said hemi-spherical configuration of the remainder of said shroud and having an opening located centrally in said quarter sphere portion and being disposed for viewing therethrough in a direction perpendicular to said center line in a line of sight extending past said bulb and free of intersecting with said bulb along all possible lines of sight in said perpendicular direction, and the overall size of said opening is less than one-half of the overall size of said quarter-sphere portion.

2. The electric trouble light assembly as claimed in claim 1, including a lens disposed in said opening of said shroud for enhancing viewing through said opening.

3. The electric trouble light assembly as claimed in claim 2, wherein said lens is removably disposed on said shroud to be replaceable thereon.

4. The electric trouble light assembly as claimed in claim 2, including a track on said shroud and arranged to slidably hold said lens on said shroud for sliding into and out of said opening.

5. The electric trouble light assembly as claimed in claim 2, including a cover movably mounted on said shroud and being arranged to cover said lens in one position of movement of said cover and to expose said lens in another position of movement of said cover.

6. The electric trouble light assembly as claimed in claim 5, wherein said cover is slidably movably mounted on said shroud for movement between the two said positions.

7. The electric trouble light assembly as claimed in claim 5, including a track on said shroud and arranged to slidably hold said cover on said shroud for sliding over and away from said opening.

8. The electric trouble light assembly as claimed in claim 2, including a track on said shroud and arranged to slidably hold said lens between positions in and away from said opening, and a cover slidably mounted on said track and being slidable between positions adjacent and away from said lens, for selective exposure and covering of said lens and said opening.

9. The electric trouble light assembly as claimed in claim 1, including a cover movably mounted on said shroud to cover said opening in one position of movement and to expose said opening in another position of movement.

10. The electric trouble light assembly as claimed in claim 1, including said bulb having a side disposed opposite said one side thereof, a mesh-type guard attached to said shroud and extending away from said shroud and adjacent to said bulb on said side thereof opposite said one side, and an opening in said guard on said line of sight for viewing through said guard.

11. The electric trouble light assembly as claimed in claim 9, including a lens disposed in said opening of said guard for enhancing viewing through said guard opening.

12. The electric trouble light assembly as claimed in claim 9, including a lens disposed in each said opening of said shroud and said guard, and with said lenses being disposed with the focal axes thereof being coincident and on said line of sight.

13. An electric trouble light assembly comprising a lamp base having a lamp socket, an electric bulb disposed in said socket and extending therefrom along a center line of said light assembly to a distant location at a farthest extremity of said bulb, a lamp shroud attached to said base and extending therefrom in a generally hemi-spherical configuration and being spaced from said bulb at a location adjacent to only one side of said bulb and extending in a hemi-spherically shaped end portion disposed beyond said distant location, said end portion being integral with and a continuation of said hemispherical configuration of the remainder of said shroud and having an opening located therein for viewing therethrough in a direction perpendicular to said center line in a line of sight extending past said bulb and free of intersecting with said bulb, a lens disposed in said opening of said shroud for enhancing viewing through said opening, said lens being removably disposed on said shroud to be replaceable thereon, and a track on said shroud and arranged to slidably hold said lens on said shroud for sliding into and out of said opening.

14. The electric trouble light assembly as claimed in claim 13, including a cover movably mounted on said shroud and being arranged to cover said lens in one position of movement of said cover and to expose said lens in another position of movement of said cover.

15. The electric trouble light assembly as claimed in claim 14, wherein said cover is slidably movably mounted on said shroud for movement between the two said positions.

16. The electric trouble light assembly as claimed in claim 14, said track on said shroud further arranged to slidably hold said cover on said shroud for sliding over and away from said opening.

17. The electric trouble light assembly as claimed in claim 13, including a cover movably mounted on said shroud to cover said opening in one position of movement and to expose said opening in another position of movement.

18. The electric trouble light assembly as claimed in claim 13, including said bulb having a side disposed opposite said one side thereof, a mesh-type guard attached to said shroud and extending away from said shroud adjacent to said bulb on said side thereof opposite said one side, and an opening in said guard on said line of sight for viewing through said guard.

19. The electric trouble light assembly as claimed in claim 18, including a lens disposed in said opening of said guard for enhancing viewing through said guard opening.

20. The electric trouble light assembly as claimed in claim 18, including a lens disposed in said opening of said guard, and with said lenses being disposed with the focal axes thereof being coincident and on said line of sight.

* * * * *